US007891583B2

(12) United States Patent
Sayers et al.

(10) Patent No.: US 7,891,583 B2
(45) Date of Patent: Feb. 22, 2011

(54) DOME PUMP SPRAY ASSEMBLY

(75) Inventors: Richard C. Sayers, Akron, OH (US); Scott T. Proper, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 176 days.

(21) Appl. No.: 12/290,412

(22) Filed: Oct. 30, 2008

(65) Prior Publication Data

US 2010/0108718 A1 May 6, 2010

(51) Int. Cl.
*B65D 1/32* (2006.01)

(52) U.S. Cl. ..... 239/327; 239/330; 239/333; 239/472; 239/480; 239/491; 239/570; 239/574; 222/207

(58) Field of Classification Search ..... 239/323, 239/327, 330, 333, 472, 487, 490, 491, 569, 239/570, 571, 574; 222/107, 207, 335, 372, 222/383.1, 385
See application file for complete search history.

(56) References Cited

U.S. PATENT DOCUMENTS 4,880,161 A * 11/1989 Wright ..... 239/330
5,100,029 A * 3/1992 Meshberg ..... 222/207
5,275,338 A * 1/1994 Tobler ..... 239/327
6,264,067 B1 * 7/2001 Lasserre ..... 239/491

* cited by examiner

*Primary Examiner*—Steven J Ganey

(57) ABSTRACT

A dome pump spray assembly employing a known structure of a liquid dome pump in association with a uniquely configured spray spout to achieve atomization of liquids such as soaps, sanitizers, disinfectants and the like. The spray spout includes a deflector which is in juxtaposition to a spout spray tip having angled partial depth passages therein that extend to a central tapered outlet orifice, the passages and orifices generating a vortex of cyclonic action that serves to achieve atomization of the liquid as it passes therethrough.

10 Claims, 2 Drawing Sheets

DOME PUMP SPRAY ASSEMBLY

TECHNICAL FIELD

The invention herein resides in the art of dispensers for soaps, sanitizers, disinfectants and the like. More particularly, the invention relates to a pump and delivery system for such dispensers. More specifically, the invention relates to a dome pump spray assembly adapted for implementation with standard liquid dispensers, and in which the liquid is dispensed in the form of a spray, utilizing a traditional dome pump.

BACKGROUND OF THE INVENTION

The implementation and utilization of dispensers of various types for dispensing set quantities of liquid such as soaps, sanitizers, disinfectants and the like are now commonly known. Many such systems employ what has become known as a dome pump for effecting the dispensing operation. Such dome pumps are commonly known to include an elastomeric dome received by a pump housing and defining a cavity therebetween. The cavity typically defines the quantity of liquid to be dispensed, and the dispensing and refilling operation is mutually exclusively achieved by valved inlets and outlets to the cavity. In the prior art, such dome pumps have only been employed for purposes of dispensing predetermined quantities of liquid in the form of a liquid. In such dispensers, a "glob" of liquid is deposited onto the user's hand when the dome pump is actuated by means of an actuator bar or other device imparting a force to the elastomeric dome of the dome pump.

Recently, it has become desirable to dispense such liquids in the form of a spray or mist, in which the liquid is atomized or otherwise separated into small particles which are dispensed upon the user's hand and which accommodate rapid and effective distribution over the user's hands, or the development of a lather as the liquid is worked with water or the like. Heretofore, it has not been deemed practical to employ a dome pump to atomize and dispense liquids, since the dispensing force characteristic of dome pumps was not deemed sufficient to achieve atomization using commonly known misting heads. But, dome pumps are widely used in known dispensers for dispensing liquids and gels. Accordingly, there is a need in the art for a spray nozzle adaptable for use with such known dome pumps for effecting a suitable spray upon actuation.

DISCLOSURE OF INVENTION

In light of the foregoing, it is a first aspect of the invention to develop a cost effective dome pump spray assembly.

Another aspect of the invention is the provision of a dome pump spray assembly that is capable of employing a commonly known dome pump, coupled with a spray head of particular design, such that the dispensing force characteristic of the dome pump is sufficient to atomize liquid through the spray head.

Yet a further aspect of the invention is the provision of a dome pump spray assembly which is staged, to maximize the misting feature with minimal force requirement.

A further aspect of the invention is the provision of a dome pump spray assembly that may be cost effectively implemented with state of the art techniques and devices.

The foregoing and other aspects of the invention that will become apparent as the detailed description proceeds are achieved by a dome actuated spray pump, comprising: a pump housing having a valved inlet and a valved outlet; a flexible dome received by said pump housing and defining a cavity therebetween, said inlet and outlet communicating with said cavity; a spray spout connected to said outlet, said spray spout comprising: a valve for said outlet at a first end of said spray spout and in operative engagement with said outlet; a deflector; and a spout spraying nozzle at a second opposite end of said spray spout.

DESCRIPTION OF DRAWINGS

For a complete understanding of the techniques, structure and aspects of the invention, reference should be made to the following detailed description and accompanying drawings wherein.

BEST MODE FOR CARRYING OUT THE INVENTION

Figure 1:
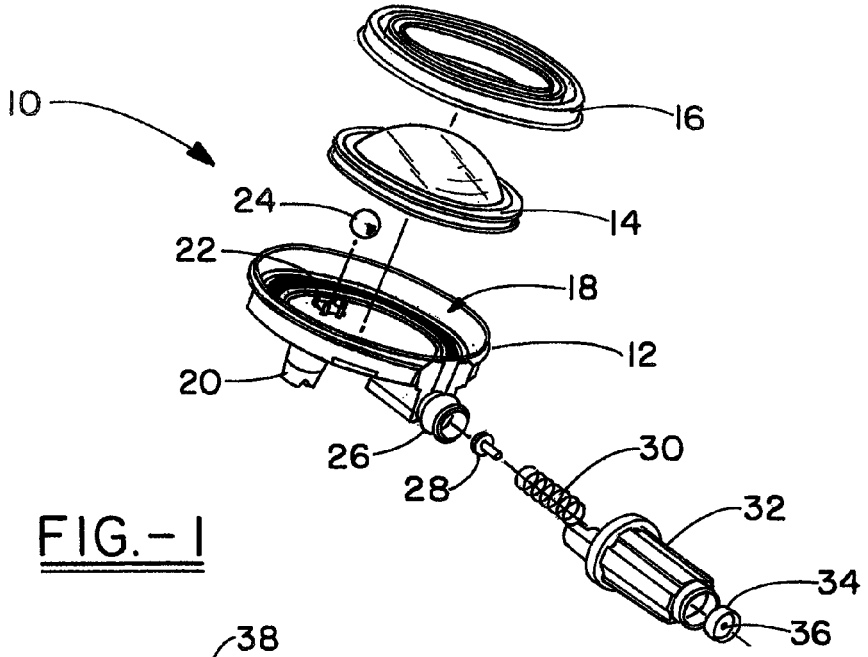
FIG. 1 is an assembly diagram of the dome actuated spray pump made in accordance with the invention.

Referring now to the drawings and more particularly FIG. 1, it can be seen that a dome spray pump assembly made in accordance with the invention is designated generally by the numeral 10. The assembly 10 includes a pump housing 12, molded of plastic or other suitable materials, and configured to receive a dome 14 of flexible elastomeric material, and secured thereto by means of a retaining ring 16, in order to form a cavity 18 between the pump housing 12 and dome 14.

An inlet nipple 20 is provided as part and parcel of the pump housing 12 and typically communicates with a mass reservoir of liquid to be dispensed, such as a cartridge of soap, sanitizer or the like. Above the inlet nipple 20 and within the cavity 18 extends a retaining cage 22 adapted for receiving and maintaining a ball seal 24 adapted for sealing the nipple 20 during the dispensing operation and opening the nipple 20 for recovery and refilling, as known to those skilled in the art.

An outlet nipple 26 is also provided as a portion of the pump housing 12. Outlet nipple 26 receives a mushroom valve or other appropriate valve 28 which is biased to the closed position by a spring 30 maintained within a spray spout 32. As will be understood by those skilled in the art, upon a dispensing operation attained by compressing the dome 14, the valve 28 is opened against the bias of the spring 30 and the ball seal 24 closes such that liquid is dispensed through the spray spout 32. The spray spout 32 includes a spout spray tip 34 having an outlet aperture 36 passing therethrough.

Figure 2:
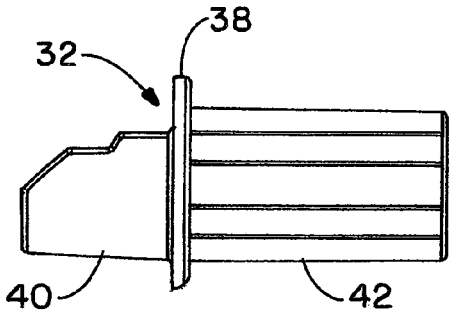
FIG. 2 is a side elevational view of the spray spout of the invention.
Figure 3:
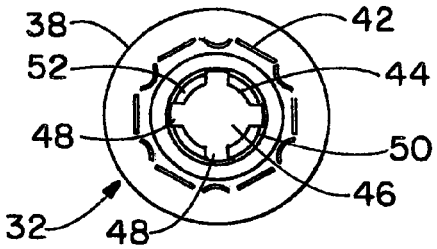
FIG. 3 is a front elevational view of the spray spout assembly of FIG. 2.

With reference now to FIGS. 2 and 3, it can be seen that the spray spout 32 comprises a molded member that includes a disk-like collar 38 having a forward nesting portion 40 extending on one side thereof, the portion 40 being contoured to nest with the perimeter of the pump housing 12 and adapted to securedly engage the outlet nipple 26 such that the mushroom valve 28 and bias spring 30 pass therethrough and into the fluted spout body portion 42. Spring 30 is urged against a deflector 44 which is maintained as part and parcel of the body portion 42 and maintained centrally therein. The deflector 44 includes a center disk 46 having legs uniformly spaced thereabout and extending outwardly therefrom to the inner circumferential wall 50 of the body portion 42, as shown. The legs 48 define therebetween passages 52 between the deflector 44 and the inner circumferential wall 50.

Figure 4:
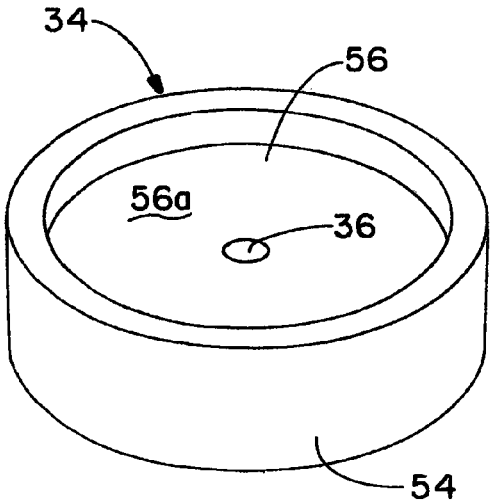
FIG. 4 is a perspective view from an exposed end of the spout spray tip of the invention.
Figure 5:
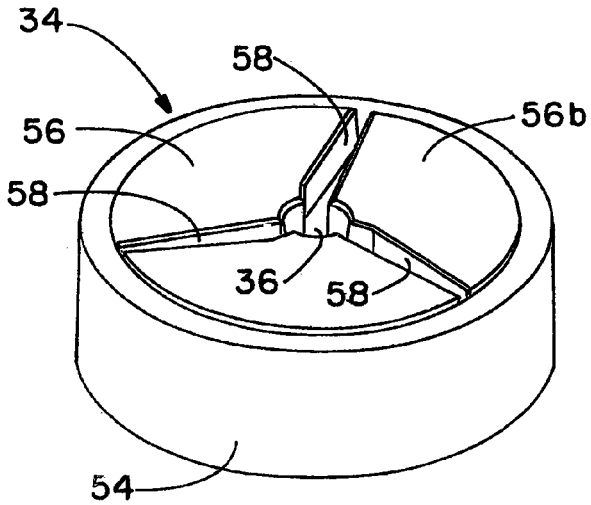
FIG. 5 is a perspective view of the concealed end of the spout spray tip assembly of FIG. 4.

As shown in FIGS. 4 and 5, the spout spray tip 34 is defined by a cylindrical wall 54 having a bottom plate 56 received thereby. The outlet aperture 36 passes through the bottom plate 56. As shown in FIG. 4, a front surface 56*a* of the bottom plate 56 is exposed when the assembly 34 is press fit within the end of the body portion 42. A rear surface 56*b* of the bottom plate 56 (FIG. 5) is concealed when the spray tip 34 is inserted into the end of the spray spout 32. The surface 56*b* is maintained in close juxtaposition to the deflector 44 when so positioned.

Figure 6:
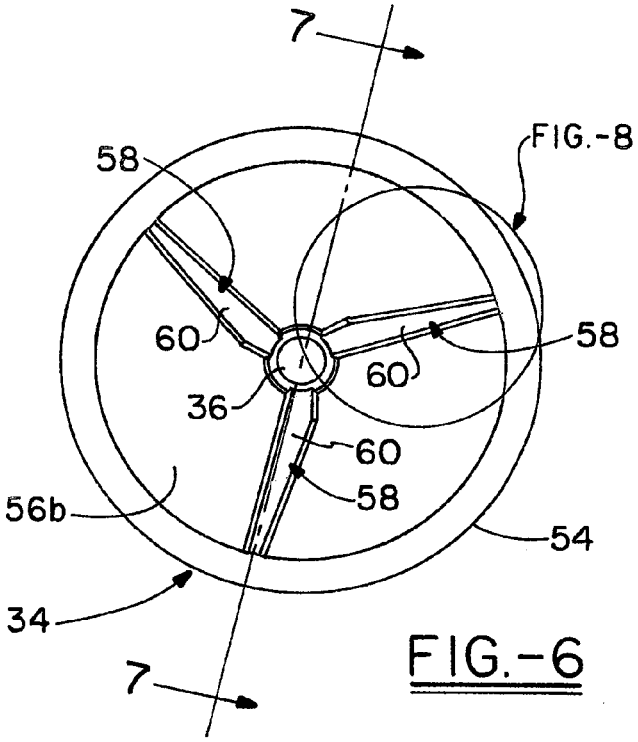
FIG. 6 is a top view of the concealed end of the spout spray tip.
Figure 7:
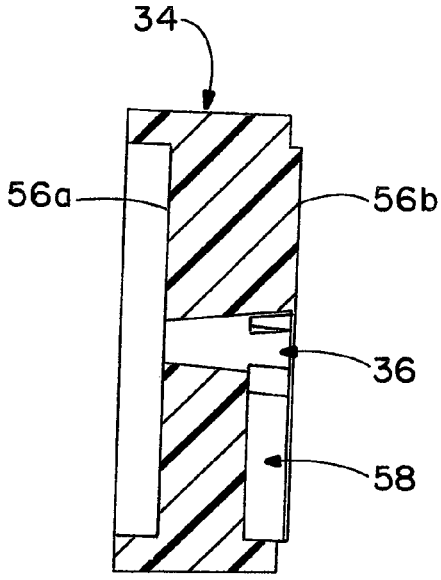
FIG. 7 is a cross sectional view of the spout spray tip of FIG. 6, taken along the line 7-7.
Figure 8:
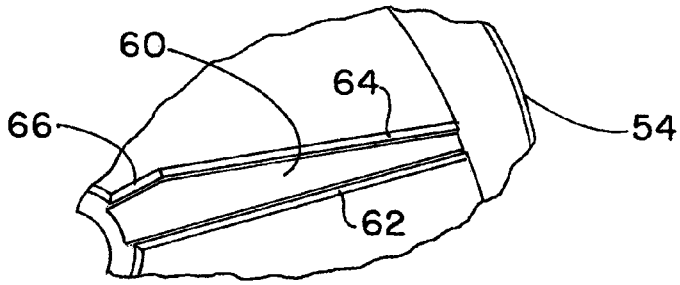
FIG. 8 is an enlarged detailed view of one of the passages formed in the concealed end of the spout spray tip.

As shown in FIGS. 5, 6 and 7 it can be seen that a plurality of partial depth dog-legged passages are formed in the rear surface 56*b* of the bottom plate 56 and extend from an inner surface of the cylindrical wall 54 inwardly into communication with the outlet aperture 36. The passages 58 are uniformly spaced and, in the embodiment shown employ three such passages, separated by 120° about the orifice 36. Each of the passages 58 includes a passage floor 60 from which extend a straight wall 62 and a dog-legged wall comprising a long section 64 and a short section 66, as shown. The walls 62-66 are beveled downwardly and inwardly toward the passage floor 60 as shown. This bevel accommodates flow of liquid during the dispensing cycle, as will be apparent below.

As shown, the walls 62, 64 extend from the wall 54 toward the orifice 36 and depart from each other at an angle of between 5-10°, and preferably 7°, as shown. The short section of wall 66, extending from the long wall 64, is substantially parallel to the straight wall 62. In a preferred embodiment of the invention, the short wall 66 is 15-30% of the length of the long wall 62.

The dogleg formed by the walls 64, 66 serves to generate a vortex in flow of liquid into the orifice 36, the orifice 36 itself being tapered inwardly at an angle of 3-8°, and preferably 5°, as it extends from a larger diameter at the surface 56*b* to a smaller diameter at the surface 56*a*. According to a preferred embodiment of the invention, the diameter of the tapered orifice 36 is, at its exit at the surface 56*a*, on the order of 0.020-0.030 inch, and preferably 0.025 inch.

It will be appreciated that the nature and number of the passages 58 may vary as a function of the nature of the liquid being dispensed and the nature of the flexible elastomeric dome 14. Similarly, the specific nature of the orifice 36 may also change. Suffice it to say that in the context of the invention, the orifice 36 is tapered to assist in developing a vortex of cyclonic action, and the passages 58 are generally angled or dog-legged to introduce a tangential flow of the liquid into the orifice 36 to assist in creating the vortex of cyclonic action, which has been found to assist in atomization of the liquid in order to generate a spray.

In operation, depressing of the dome 14 forces the ball valve 24 closed and the mushroom valve 28 open such that the liquid contained in the cavity 18 is forced through the spray spout 32. Within the spout 32, the deflector 44 separates the liquid flow into four regions adjacent the inner circumference of the inner circumferential wall 50. With the spout spray tip or atomizer 34 being maintained in close juxtaposition to the deflector 44, the liquid is forced from the passages 52 into the partial depth passages 58 where the liquid is directed generally radially inwardly in an angled dog-legged fashion to enter the orifice passage 36 in a slightly tangential manner to generate a vortex of cyclonic action, which continues as the liquid passes through the tapered passage 36, resulting in atomization of the liquid and creation of the spray.

Thus it can be seen that the various aspects of the invention have been satisfied by the structure and technique presented above. While in accordance with the patent statutes only the best known and preferred embodiment of the invention has been presented and described in detail, the invention is not limited thereto or thereby. Accordingly, for an appreciation of the true scope and breadth of the invention reference should be made to the appended claims.

What is claimed is:

1. A dome actuated spray pump, comprising:

a pump housing having a valved inlet and a valved outlet;

a flexible dome received by said pump housing and defining a cavity therebetween, said inlet and outlet communicating with said cavity;

a spray spout connected to said outlet, said spray spout comprising:

a valve for said outlet at a first end of said spray spout and in operative engagement with said outlet;

a deflector comprising a disk defining passages between outer peripheral edges of said disk and an inner wall of said spray spout; and a spout spraying nozzle at a second opposite end of said spray spout, said spout spraying nozzle comprising a cup-shaped member defined by a cylindrical wall encompassing a bottom plate and having an orifice passing through said bottom plate, wherein a first surface of said bottom plate defines an outer end surface of said spray spout, a second opposite surface of said bottom plate is in juxtaposition to said deflector, and said second opposite surface is characterized by a plurality of substantially identical partial depth passages interconnecting with said orifice and uniformly spaced about said orifice, wherein said partial depth passages extend from said inner wall of said spray spout to said orifice and increase in cross section as they extend away from said inner wall, wherein each of said partial depth passages comprises a pair of separated walls and a passage floor, wherein one wall of each of said pair of walls of said partial depth passages is substantially straight, and the other wall is dog-legged.

2. The dome actuated spray pump according to claim 1, wherein said inner wall of said spray spout is cylindrical.

3. The dome actuated spray pump according to claim 2, wherein said disk of said deflector is further characterized by uniformly spaced radial arms extending therefrom and defining said passages therebetween.

4. The dome actuated spray pump according to claim 1, wherein a top edge of each of said walls is beveled.

5. The dome actuated spray pump according to claim 4, wherein said dog-legged wall has a first section spaced from said first wall and separating therefrom at an angle of 5-10°, and a second section connected to said first section and extending substantially parallel to said first wall.

6. The dome actuated spray pump according to claim 5, wherein said first section is more than three times the length of said second section.

7. The dome actuated spray pump according to claim 5, wherein said orifice diminishes in diameter as it extends from said second side to said first side of said spout spray tip.

8. The dome actuated spray pump according to claim 7, wherein said plurality of partial depth passages comprises three such passages.

9. The dome actuated spray pump according to claim 5, wherein said dog-legged walls generate a vortex of cyclonic action into said orifice and which continues through said orifice.

10. The dome actuated spray pump according to claim 9, wherein said partial depth passages are in communication with said passage defined between said peripheral edges of said deflector and said inner wall of said spray spout.

* * * * *